US006386077B1

(12) United States Patent
Hartman

(10) Patent No.: US 6,386,077 B1
(45) Date of Patent: May 14, 2002

(54) PLIERS FOR REMOVAL OF SPRING-SECURED ELECTRICAL TERMINALS

(76) Inventor: Robert Hartman, P.O. Box 1, Thaxton, VA (US) 24174

( * ) Notice: Subject to any disclaimer, the term of this patent is extended or adjusted under 35 U.S.C. 154(b) by 0 days.

(21) Appl. No.: 09/649,915

(22) Filed: Aug. 30, 2000

(51) Int. Cl.[7] ..... B25B 7/02
(52) U.S. Cl. ..... 81/426; 81/426.5
(58) Field of Search ..... 81/418, 421, 426, 81/426.5

(56) References Cited

U.S. PATENT DOCUMENTS 1,570,708 A * 1/1926 Roush ..... 81/426 X
2,507,981 A 5/1950 Krause
2,913,743 A * 11/1959 Bingham ..... 81/426 X
3,908,490 A * 9/1975 Durham ..... 81/426.5 X
4,353,273 A 10/1982 Freberg
4,651,554 A 3/1987 Grudzinskas
4,697,483 A 10/1987 Rodgers
5,209,143 A 5/1993 Sweet
5,212,859 A 5/1993 Hagerty
5,327,802 A 7/1994 Yu
5,351,402 A * 10/1994 Mansfield ..... 81/426 X
5,590,573 A 1/1997 Detable
5,732,461 A * 3/1998 Keffeler et al. ..... 81/421 X

* cited by examiner

*Primary Examiner*—James G. Smith
(74) *Attorney, Agent, or Firm*—Norman Rainer

(57) ABSTRACT

Pliers of specialized construction for depressing the retaining spring of an electrical connector terminal include a rigid thin blade extending forwardly of the jaws of the pliers. A recess, disposed in the blade, is positioned and shaped in a manner to accommodate a retaining shoulder that is generally positioned in front of the spring and would otherwise block access of the pliers to the spring.

6 Claims, 1 Drawing Sheet

PLIERS FOR REMOVAL OF SPRING-SECURED ELECTRICAL TERMINALS

BACKGROUND OF THE INVENTION

1. Field of the Invention

This invention relates to specialized pliers for removing spring-secured electrical connectors from a housing.

2. Description of the Prior Art

Battery-operated industrial fork lift trucks are extensively used for the handling of heavy loads in factory, warehouse and other commercial applications. The battery-operated lift trucks are preferred over fuel-driven trucks because they are quieter in operation and do not emit combustion gases which would adversely affect an indoor environment.

The batteries of such electrically driven lift trucks require frequent recharging. To facilitate the connection of the batteries to a suitable electrical DC power source, receiving connector terminals are provided on the truck and are adapted to interact with feed connector terminals associated with the power source. The receiving connector terminals are generally secured by a protective housing which maintains the terminals in parallel, spaced apart relationship. In particularly popular embodiments, the receiving terminals have an elongated flattened configuration provided with an engagement hump, and are spring-urged toward a latching position. The feed terminals from the power source are similarly secured within a protective housing and spaced apart to match the spacing of the receiving terminals. The feed terminals have a flattened configuration with an engaging hump comparable to the receiving terminals and are also spring-urged toward a latching position. One set of terminals, whether the feed or receiving terminals is caused to protrude from a male-designated housing and adapted to enter a female-configured housing wherein the opposing interactive terminals are recessed within the housing.

In view of the aforesaid construction, the mating of the feed terminals with the receiving terminals is quickly and easily accomplished merely by pushing one housing toward the other axially with respect to the direction of elongation of the terminals. Such action brings the opposed terminals into secure engagement with properly maintained polarity. By virtue of the interlocking effect achieved by the interactive engagement humps and the springs which force the terminals together as a latched state, the terminals resist inadvertent separation.

In the course of prolonged use, the receiving and feed connector terminals must be removed from their housings for servicing. It has been found, however, that such removal is extremely difficult because of the aforesaid springs which secure the terminals in place. Removal of terminals from female-configured housings is particularly difficult because, not only must said spring be depressed to facilitate removal, but it is difficult to reach into the housing in order to access the spring.

Various types of specialized hand tools have earlier been disclosed for coping with difficult manipulative tasks. For example, plier-type tools designed for handling spring components are disclosed in U.S. Pat. Nos. 4,697,483; 5,212,859; 5,209,143 and 5,590,573. However, the tools of each of said Patents involve motions which apply force against two extremities of a spring in order to achieve movement or configurational change of the spring. U.S. Pat. Nos. 4,353,273 and 5,209,143 disclose pliers of substantially conventional design having opposing jaws which are modified to accomplish very specific tasks. None of the aforesaid Patents disclose pliers specifically designed to force an otherwise inaccessible spring against a fixed feature of a multi-component structure in order to permit sliding release of a component otherwise secured by said spring.

It is accordingly an object of the present invention to provide a hand tool for facilitating the release of a spring-held electrical terminal from a connector housing.

It is a further object of this invention to provide a hand tool of the foregoing object in the form of pliers of substantially conventional design but with a specially modified jaw configuration.

It is another object of the present invention to provide a hand tool of the aforesaid nature wherein said modified jaw configuration permits depression of a holding spring against a fixed feature of said housing.

It is a still further object of this invention to provide pliers of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by pliers of the type comprised of first and second elongated members connected at a pivot axis to define interactive first and second jaws and opposed handle portions arranged such that said jaws are brought together when said handle portions are brought to their position of closest approach within an action plane orthogonal to said pivot axis. Said first jaw, having a substantially flat gripping surface, extends to a forward end located a distance from said pivot axis which is generally considered typical of pliers. Said second jaw extends to a front end located closer to said pivot axis than the forward end of said first jaw, and having a rigid thin blade extending forwardly of said front end and positioned substantially on said action plane. Said blade extends to a leading edge located forwardly of the forward end of said first jaw, and is further provided with a gripping edge adapted to contact the gripping surface of said first jaw, and a recess located adjacent the front end of said second jaw and directed away from said gripping edge.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
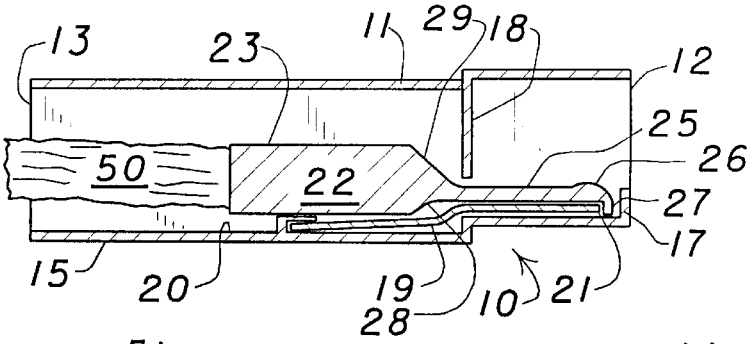
FIG. 1 is a sectional side view of an embodiment of a female terminal connector serviceable by the pliers of the present invention.
Figure 2:
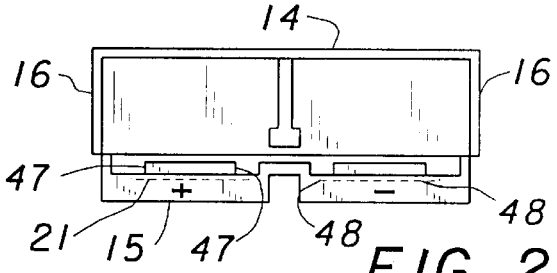
FIG. 2 is a front view of the connector of FIG. 1.
Figure 3:
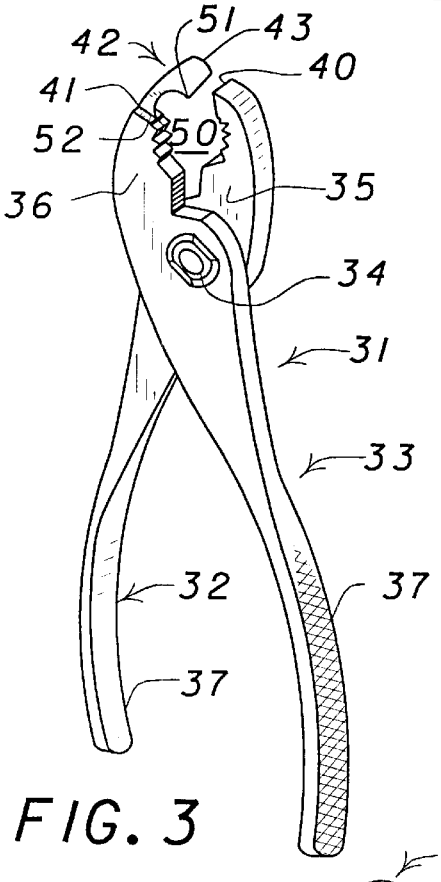
FIG. 3 is a side perspective view of an embodiment of the pliers of the present invention shown in a partially open state.

Referring now to FIGS. 1 and 2, a female electrical terminal connector 10 is shown comprised of a plastic housing 11 elongated between open front and rear extremities 12 and 13, respectively, and further bounded by top and bottom panels 14 and 15, respectively, and side panels 16.

Housing 11, generally fabricated of plastic as a monolithic molded structure, further contains a front retaining shoulder 17 and interior abutment wall 18. A flat spring 19, bounded in part by opposed side edges 48, is emplaced upon the interior surface 20 of bottom panel 15, and extends to an upwardly biased leading extremity 21. Two electrical terminals 22, designated positive and negative, are disposed in separated side-by-side juxtaposition within said housing. Each terminal is comprised of a hollow rear extremity 23 adapted to receive an electrical conductor cable 50, and a distal portion 25 having a flat contour bounded in part by opposed side edges 47 causing said distal portion to be of narrower horizontal width than the underlying spring 19. Said distal portion further includes an upwardly raised engaging hump 26 and a downwardly turned lip 27 adapted to engage the leading extremity 21 of spring 19. A transition zone 28, located between rear extremity 23 and distal portion 25, has a conically tapered surface 29 adapted to contact abutment wall 18, thereby stabilizing the terminal with respect to forward movement.

By virtue of the aforesaid construction, spring 19 secures the terminals in a proper fixed position within the housing, and also enables similarly spring-biased male terminals to be inserted into locked joinder with terminals of a female-configured housing. Said construction also permits rearward sliding removal of the terminal when the leading extremity 21 of the spring is depressed. However, the construction of terminal connector 10 is such as to make it very difficult to reach inside housing 11 through front extremity 12 and depress spring 19. It is for just such purpose that the pliers of the present invention has been invented.

Referring now to FIGS. 3–6, an embodiment of the pliers 31 of the present invention is shown comprised of first and second elongated members 32 and 33, respectively, connected by pivot bolt 34 to define interactive first and second jaws 35 and 36, respectively, and opposed handle portions 37. The pliers are constructed such that said elongated members 32 and 33 are adapted to move in scissor-like relationship about a centered plane of action 38 orthogonally disposed to bolt 34. In the course of said scissor-like motion, said jaws are brought together when said handle portions are brought to their position of closest approach. Such movement also defines an embracing region 50.

First jaw 35, having a substantially flat gripping surface 39 disposed orthogonally to said action plane, extends to a forward end 40 located a distance from said pivot bolt which is generally considered typical of pliers. Second jaw 36 extends to a front end 41 located closer to pivot bolt 34 than the forward end 40 of said first jaw. A rigid thin blade 42 extends forwardly from said second jaw substantially upon said action plane. Blade 42 extends to a leading surface 43 located forwardly of forward end 40 of said first jaw, and is further bounded by outer surface 44 and gripping surface 45 adapted to contact gripping surface 39 of said first jaw. A recess 46 is formed in blade 42 at a location between gripping surface 45 and the front end 41 of said second jaw. Recess 46 has a mouth extremity 51 which opens onto region 50, and a closed extremity 52 directed toward outer surface 44. Although the exemplified embodiment of recess 46 is shown to have an arcuate configuration concavely contoured with respect to region 50, other configurations of said recess may be employed. It is preferred however, that mouth extremity 51 is larger, measured in said action plane, than said closed extremity. Blade 42 may be either a continuous integral extension of said second jaw or may be affixed to said jaw by way of insertion into a receiving groove, followed by welded securement.

Figure 4:
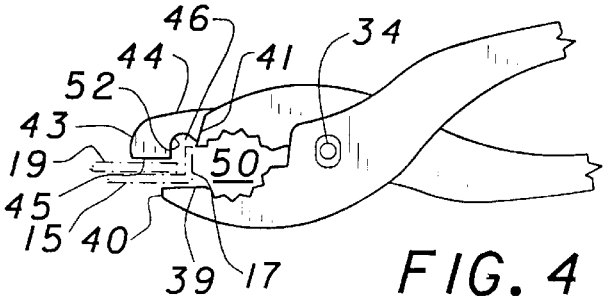
FIG. 4 is a fragmentary side view of the pliers of FIG. 3 shown in its closed state in operative engagement with the connector of FIG. 1.
Figure 5:
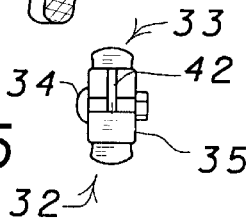
FIG. 5 is a front view of the embodiment of FIG. 4.
Figure 6:
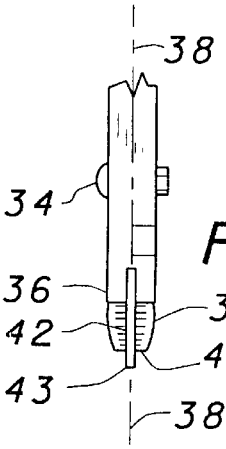
FIG. 6 is a fragmentary top view of the pliers of FIG. 4.

By virtue of this specialized construction, the pliers of this invention can be employed, as shown in FIG. 4, to reach into housing 11 and depress the leading extremity 21 of spring 19. Such action, which permits the release of electrical terminal 22, is achievable because blade 42 can enter the housing, and its gripping surface 45 can contact the upper surface of spring 19 where it extends laterally beyond the distal portion 25 of the terminal. Such function is permitted because recess 46 accommodates front retaining shoulder 17 when the jaws are positioned such that gripping surface 39 of said first jaw rests in abutment with bottom panel 15 beneath retaining shoulder 17.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In pliers of the type comprised of first and second elongated members connected at a pivot axis to define interactive first and second jaws and opposed handle portions arranged such that said jaws are brought together and further define an embracing region when said handle portions are brought in scissor-like motion to their position of closest approach within an action plane orthogonal to said pivot axis, the improvement wherein:

a) said first jaw has a substantially flat gripping surface and extends to a forward end, and b) said second jaw extends to a front end located closer to said pivot axis than the forward end of said first jaw, and has a rigid thin blade extending forwardly of said front end and positioned substantially on said action plane, said blade extending to a leading surface located forwardly of the forward end of said first jaw, and further provided with a gripping surface adapted to contact the gripping surface of said first jaw, and a recess in said blade located between said gripping surface and the front end of said second jaw.

2. The improved pliers of claim 1 wherein said blade is a continuous integral extension of said second jaw.

3. The improved pliers of claim 1 wherein said blade is affixed to said second jaw by way of insertion into a receiving groove, followed by welded securement.

4. The improved pliers of claim 1 wherein said recess has a closed extremity and a mouth extremity which opens into said embracing region.

5. The improved pliers of claim 4 wherein said recess has an arcuate configuration concavely contoured with respect to said embracing region.

6. The improved pliers of claim 5 wherein said mouth extremity is larger, measured in said action plane, than said closed extremity.

* * * * *